US005888113A

United States Patent [19]

Anderson et al.

[11] Patent Number: 5,888,113

[45] Date of Patent: Mar. 30, 1999

[54] PROCESS FOR MAKING A CESIATED DIAMOND FILM FIELD EMITTER AND FIELD EMITTER FORMED THEREFROM

[75] Inventors: David F. Anderson, Batavia; Simon W. Kwan, Geneva, both of Ill.

[73] Assignee: Universities Research Association, Inc., Washington, D.C.

[21] Appl. No.: 829,492

[22] Filed: Mar. 27, 1997

[51] Int. Cl.[6] ..... H01J 9/02

[52] U.S. Cl. ..... 445/51; 445/58; 313/311; 427/78

[58] Field of Search ..... 445/51, 58; 427/78; 313/311, 309

[56] References Cited

U.S. PATENT DOCUMENTS

| | | | |
|---|---|---|---|
| 5,138,237 | 8/1992 | Kane et al. . | |
| 5,399,238 | 3/1995 | Kumar . | |
| 5,410,166 | 4/1995 | Kennel | 257/77 |
| 5,463,271 | 10/1995 | Geis et al. . | |
| 5,597,762 | 1/1997 | Popovici et al. | 438/558 |
| 5,713,775 | 2/1998 | Geis et al. | 445/35 |
| 5,728,435 | 3/1998 | Geis et al. | 437/535 |
| 5,729,094 | 3/1998 | Geis et al. | 315/169.1 |

OTHER PUBLICATIONS

"Photonic Displays Take to the Road", *Photonics Spectra,* S. Palalau, Apr. 1996.

"Innovation Spurs Hardware Advances", *R&D Magazine,* vol. 38, No. 13, T. Studt, Apr. 1996.

"On Permanent Displays", *Scientific American,* W. Gibbs, May 1996.

"New Electron Emitters May Slim Down Computer Displays", *Science,* vol. 273, A. Hellemans, Aug. 1996.

"Picture Tubes Hang in There", *Information Display,* vol. 12, No. 9, J. Hallett et al., Sep. 1996.

Can FED 'Davids' Vanquish The AMLCD 'Goliaths'?, *R&D Magazine,* vol. 38, No. 13, V. Comello, Dec. 1996.

"Diamond And DLC Coatings"product brochure, General Vacuum, Inc., Cleveland, Ohio, before Mar. 1997.

*Primary Examiner*—Kenneth J. Ramsey

*Attorney, Agent, or Firm*—McAndrews, Held & Malloy, Ltd.

[57] ABSTRACT

A process for making a cesiated diamond film comprises (a) depositing a quantity of cesium iodide on the diamond film in a vacuum of between about $10^{-4}$ Torr and about $10^{-7}$ Torr, (b) increasing the vacuum to at least about $10^{-8}$ Torr, and (c) imposing an electron beam upon the diamond film, said electron beam having an energy sufficient to dissociate said cesium iodide and to incorporate cesium into interstices of the diamond film. The cesiated diamond film prepared according to the process has an operating voltage that is reduced by a factor of at least approximately 2.5 relative to conventional, non-cesiated diamond film field emitters.

11 Claims, 1 Drawing Sheet

PROCESS FOR MAKING A CESIATED DIAMOND FILM FIELD EMITTER AND FIELD EMITTER FORMED THEREFROM

This invention was made with Government support under Contract No. DE-AC02-76CH03000 awarded by the United States Department of Energy. The Government has certain rights in the invention.

FIELD OF THE INVENTION

The present invention relates to a process for incorporating cesium into the surface of a diamond film, as well as a field emitter formed from the cesiated diamond film. The cesiated diamond film has an operating voltage that is reduced by a factor of 2.5 or greater relative to conventional diamond film field emitters.

BACKGROUND OF THE INVENTION

In recent years, diamond has become a preferred material for solid state microelectronic devices due to its favorable thermal, chemical and electronic properties such as negative electron affinity. Diamond is also regarded as the most promising material for field emitters, as well as for coatings for microfabricated field emission devices. Because of its well-established role in microprocessing technology, silicon remains a favored substrate material for fabricating field emission devices. It is desirable to deposit a thin diamond film on silicon emitter surfaces in order to enhance and stabilize the electron emission.

Field emission devices ("FEDs") generally employ an array of small electron-emitting cathodes. In contrast to cathode ray tubes ("CRTs"), FEDs do not operate by scanning. Several hundred cathodes activate the phosphors at each pixel. The cathodes are located directly below the pixel they serve, thereby allowing the thickness of the FED panel to be reduced to only several millimeters. In addition, while the CRT is a hot-cathode device, FEDs employ cold cathodes that produce electrons through room-temperature field emission.

In conventional field emitters, high operating voltages are required and, as a consequence, accidental discharge between neighboring pixels occasionally occurs. The present cesiated diamond film reduces the severity of this problem by reducing the operating voltage by a factor of 2.5 or greater.

SUMMARY OF THE INVENTION

A process for making a cesiated diamond film comprises the following steps:

(a) depositing a quantity of cesium iodide on the diamond film in a vacuum of between about $10^{-4}$ Torr and about $10^{-7}$ Torr;

(b) increasing the vacuum to at least about $10^{-8}$ Torr;

(c) imposing an electron beam upon the diamond film, the electron beam having an energy sufficient to dissociate the cesium iodide and to incorporate cesium into interstices of the diamond film.

As used herein, the phrase "increasing the vacuum" means increasing the negative exponent of the Torr value. For example, the vacuum level of a chamber increases from $10^{-7}$ Torr to $10^{-8}$ Torr.

In the preferred process, the energy of the electron beam is about 0.5 keV to about 4 keV, most preferably about 1 keV. The diamond film is preferably maintained at a temperature less than the vaporization temperature of cesium iodide, most preferably less than about 100° C. The cesium iodide is deposited on the diamond film in a thickness of about 100 Å.

The process optionally further comprises, after step (c), depositing a further quantity of cesium iodide on the cesiated diamond film. The further quantity of cesium iodide is preferably deposited on the diamond film in a thickness of between about 30 Å and about 50 Å.

The present cesiated diamond film field emitter has application in flat panel displays, as well as in conventional CRTs and for portable x-ray machines. In the case of CRTs, the present cesiated diamond film field emitter offers lower energy consumption. For portable x-ray generators, the cesiated diamond field emitter would provide a sharper focus and would be more rugged and resistant to mechanical shock.

DETAILED DESCRIPTION OF THE PREFERRED EMBODIMENTS

Figure 1:
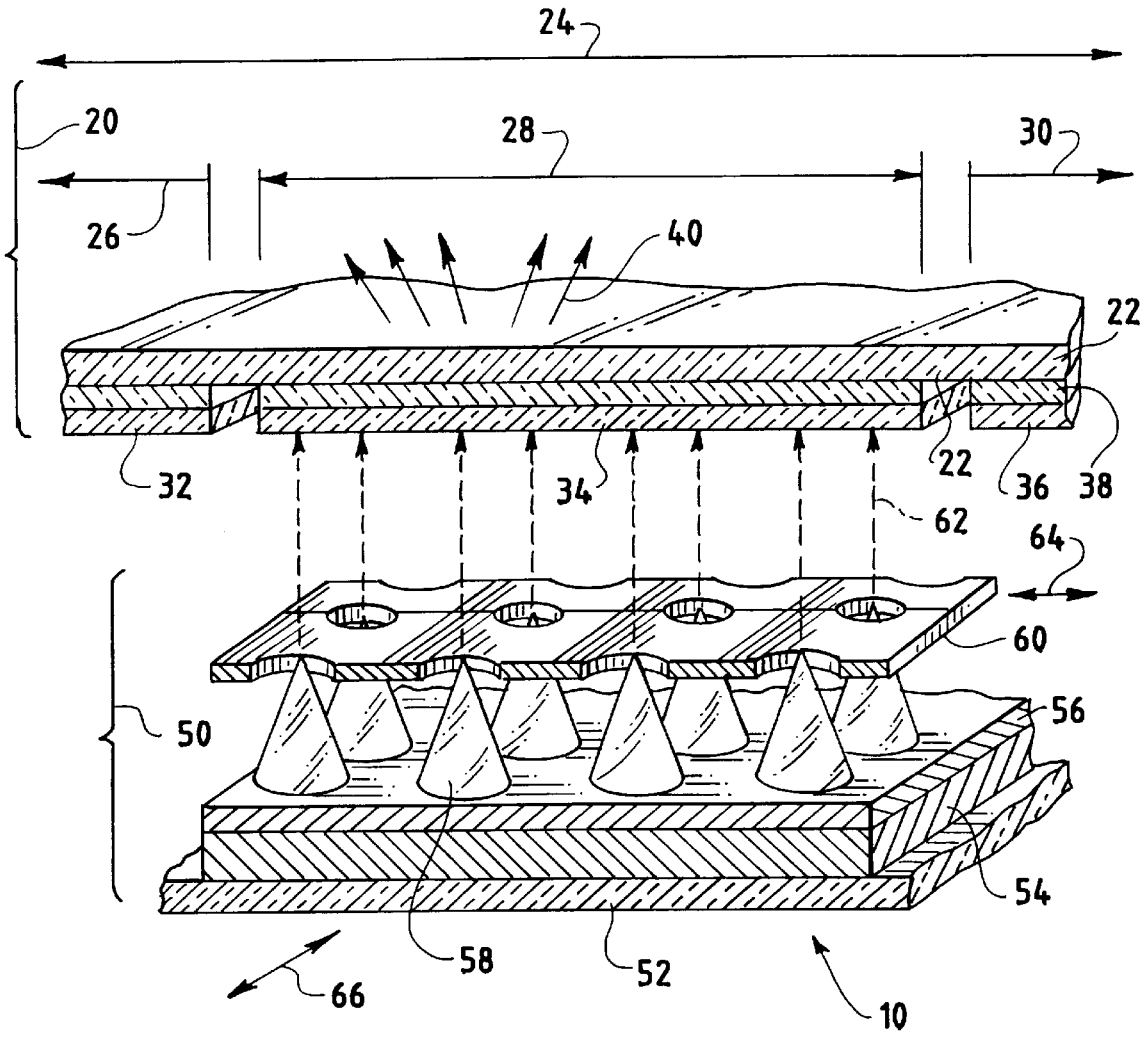
FIG. 1 is a schematic diagram of a field emission display incorporating the present cesiated diamond film.

FIG. 1 is a schematic diagram of a field emission display ("FED") 10 incorporating the present cesiated diamond film. FED 10 includes an anode 20 and a cathode 50. Anode 20 includes a glass face plate 22 having individual pixel regions, one region of which is designated in FIG. 1 by the double-headed arrow 24. Individual pixel region 24, in turn, includes a plurality of color sub-pixel regions, three of which are designated in FIG. 1 as red sub-pixel region 26, green sub-pixel region 28 and blue sub-pixel region 30. Anode 20 also includes a plurality of color phosphor regions, three of which are designated in FIG. 1 as red phosphor region 32, green phosphor region 34 and blue phosphor region 36. As shown in FIG. 1, color phosphor regions 32, 34, 36 correspond to color sub-pixel regions 26, 28, 30, respectively. An optically transparent, electrically conductive layer 38, preferably formed from indium tin oxide (sometimes referred to as "ITO"), is interposed in anode 20 between glass face plate 22 and color phosphor regions 32, 34, 36.

As further shown in FIG. 1, cathode 50 of FED 10 includes a bottom glass layer 52, a cathode conductor layer 54, a resistive layer 56, and a plurality of electron field emissive microtips, one of which is designated in FIG. 1 as microtip 58. Each microtip 58 has cesiated diamond film disposed as a coating on the tip portion thereof. Cathode 50 also includes a gate layer 60.

In operation, a voltage potential applied between anode 20 and cathode 50 will induce each microtip 58 to emit electrons, one stream of which is shown schematically in FIG. 1 as electron stream 62. The openings of gate layer 60 are selectively charged to either permit or impede the passage of electrons through the openings in gate layer 60. In FIG. 1, the electron emission streams are shown as emanating from microtips 58 through the openings in gate layer 60 and toward green phosphor region 34 of anode 20. The interaction of the electron emission stream 62 with a quantity of green phosphor in region 34 will induce the emission of photons 40 in the green visible light region, thereby inducing pixel 24 to appear green.

In FIG. 1, double-headed arrow 64 designates a pixel row line of FED 10. Double-headed arrow 66 designates a pixel column line of FED 10.

As shown in FIG. 1, anode 20 and cathode 50 are spaced. The distance being the anode and cathode is approximately 2.5 millimeters.

Figure 2:
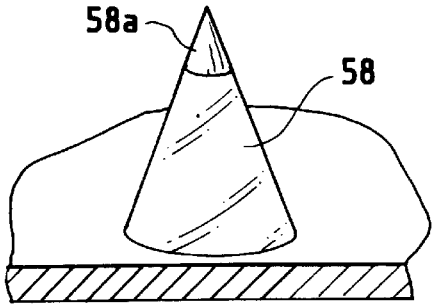
FIG. 2 is an enlarged view of one of the electron field emissive microtips illustrated in FIG. 1 having cesiated diamond film disposed as a coating on the tip portion thereof.

FIG. 2 shows one of the electron field emissive microtips 58 illustrated in FIG. 1 having a cesiated diamond film coating 58*a* disposed on the tip portion thereof.

Preparation of a cesiated diamond film field emitter (1) In a vacuum of $10^{-7}$ Torr, deposit a 100 Å thick layer of CsI on diamond film previously deposited on the surface of a substrate. While the vacuum is preferably $10^{-7}$ Torr, the vacuum should be at least $10^{-4}$ Torr. The diamond film is preferably previously deposited on the surface of the substrate by chemical vapor deposition ("CVD"); however, other deposition techniques could be employed as well. The thickness of CsI deposited on the CVD diamond film should be sufficient to provide a quantity of Cs to interact with the diamond surface, preferably 50 Å–100 Å, most preferably about 100 Å. The CsI is preferably deposited on the substrate surface by exposing the diamond film to CsI vapor using resistance heating or electron beam heating of CsI.

(2) Pump to $10^{-8}$ to $10^{-9}$ Torr. A sufficient vacuum must be applied because oxygen competes with the diamond for free Cs.

(3) Start electron beam activation:

(a) An approximately 0.5–4.0 keV electron beam, preferably a 1 keV electron beam, is employed to cesiate the surface of the diamond film. Electron beams greater than 4.0 keV would penetrate the diamond film well below the surface, where the cesiated diamond film would be ineffective for displays and therefore an inefficient use of electron beam energy.

(b) Keep target temperature at or below 100° C. (the temperature determines the current). If the temperature is too great, the CsI will undesirably vaporize.

(c) The electron beam is generally applied at about 1 milliamp for a 2 inch wafer.

(d) The activation generally takes about 3 days. The activation time could be reduced by cooling the diamond film surface to permit the employment of electron beam current levels greater than 1 milliamp. The activation time could also be reduced by optimizing (minimizing) the CsI coating on the diamond film surface.

(4) Optionally, verify that the diamond film has been activated using secondary electron emission:

(a) A 1–3 keV electron beam is directed onto the diamond film with the film held at a small (approximately -50 V) negative potential.

(b) The current from the diamond, which represents the secondary electron current leaving the diamond film minus the electron beam current, is measured. An enhanced secondary electron yield indicates cesiation of the diamond. A maximization of this yield indicates complete cesiation.

(c) Scan a focussed electron beam over the diamond film surface to determine whether activation was uniform by measuring the uniformity of the secondary electron emission.

(d) Focus the electron beam on a single spot to determine whether further activation is possible by looking for an increase in secondary electron emission with time.

(5) Optionally, continue activation by returning to the wide-area electron beam source.

(6) Optionally, overcoat the cesiated diamond film for protection against handling during exposure to atmospheric air.

(a) Before removing the cesiated diamond film from the vacuum, heat CsI using resistive or electron beam heating.

(b) When CsI is heated to a temperature yielding a proper rate of deposition (about 5 Å/sec), expose sample to CsI.

(c) Deposit a CsI overcoat with a thickness of approximately 30 Å–50 Å.

The cesiated diamond film prepared according to the above-described process has an operating voltage that is reduced by a factor of at least 2.5 relative to conventional, non-cesiated diamond film field emitters.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. A process for making a cesiated diamond film comprising the following steps:

(a) depositing a quantity of cesium iodide on the diamond film in a vacuum of between about $10^{-4}$ Torr and about $10^{-7}$ Torr;

(b) increasing said vacuum to at least about $10^{-8}$ Torr;

(c) imposing an electron beam upon the diamond film, said electron beam having an energy sufficient to dissociate said cesium iodide and to incorporate cesium into interstices of the diamond film.

2. The process of claim 1 wherein the energy of said electron beam is about 0.5 keV to about 4 keV.

3. The process of claim 2 wherein the energy of said electron beam is about 1 keV.

4. The process of claim 1 wherein the diamond film is maintained at a temperature less than the vaporization temperature of cesium iodide.

5. The process of claim 4 wherein said temperature is less that about 100° C.

6. The process of claim 1 wherein said cesium iodide is deposited on said diamond film in a thickness of about 100 Å.

7. The process of claim 1 further comprising, after step (c), depositing a further quantity of cesium iodide on the cesiated diamond film.

8. The process of claim 7 wherein said further quantity of cesium iodide is deposited on said diamond film in a thickness of between about 30 Å and about 50 Å.

9. A cesiated diamond film prepared according to the process of claim 1 wherein said film is employed as an electron field emitter in a flat panel display.

10. A cesiated diamond film prepared according to the process of claim 1 wherein said film is employed as an electron field emitter in a cathode ray tube.

11. A cesiated diamond film prepared according to the process of claim 1 wherein said film is employed as an electron field emitter in an x-ray generator.

* * * * *